US006984087B1

(12) United States Patent
Reinbold et al.

(10) Patent No.: US 6,984,087 B1
(45) Date of Patent: Jan. 10, 2006

(54) WRITING AND CANDY UTENSIL

(76) Inventors: Paul Reinbold, 1678 Prairie Ave., #3, Dickinson, ND (US) 58601; Shane Weber, 1678 Prairie Ave., #3, Dickinson, ND (US) 58601

( * ) Notice: Subject to any disclaimer, the term of this patent is extended or adjusted under 35 U.S.C. 154(b) by 26 days.

(21) Appl. No.: 11/045,532

(22) Filed: Jan. 31, 2005

(51) Int. Cl.
*B43K 29/00* (2006.01)

(52) U.S. Cl. ..... 401/195; 401/52; 401/34; 401/49

(58) Field of Classification Search ..... 401/195, 401/52, 49, 243, 202, 98, 88, 61
See application file for complete search history.

(56) References Cited

U.S. PATENT DOCUMENTS 1,104,514 A * 7/1914 Kilstrom ..... 401/52
5,951,184 A * 9/1999 Sanchez ..... 401/52
6,004,597 A * 12/1999 Coleman et al. ..... 401/52
6,200,046 B1 * 3/2001 Rylander ..... 401/52

FOREIGN PATENT DOCUMENTS

WO WO 98/43829 * 10/1998

* cited by examiner

*Primary Examiner*—Khoa D. Huynh
(74) *Attorney, Agent, or Firm*—David A. Lingbeck

(57) ABSTRACT

A writing & candy utensil for giving a user something sweet to chew on rather than the end of the writing utensil. The writing & candy utensil includes an elongate tubular member having open front and back ends; and also includes a writing tip being disposed at the front end of the elongate tubular member; and also includes a candy support assembly being removably attached to the elongate tubular member; and further includes a piece of hard candy being removably supported by the candy support assembly.

4 Claims, 2 Drawing Sheets

WRITING AND CANDY UTENSIL

BACKGROUND OF THE INVENTION

1. Field of the Invention

The present invention relates to writing and candy utensils and more particularly pertains to a new writing & candy utensil for giving a user something sweet to chew on rather than the end of the writing utensil.

2. Description of the Prior Art

The use of writing and candy utensils is known in the prior art. More specifically, writing and candy utensils heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,615,596; U.S. Pat. No. 5,951,184; U.S. Pat. No. 2,617,324; U.S. Pat. No. 5,826,997; U.S. Pat. No. 6,004,597; and U.S. Pat. No. Des. 353,157.

While these devices fulfill their respective, particular objectives and requirements, the aforementioned patents do not disclose a new writing & candy utensil. The prior art includes various types of writing utensils.

SUMMARY OF THE INVENTION

The general purpose of the present invention, which will be described subsequently in greater detail, is to provide a new writing & candy utensil which has many of the advantages of the writing and candy utensils mentioned heretofore and many novel features that result in a new writing & candy utensil which is not anticipated, rendered obvious, suggested, or even implied by any of the prior art writing and candy utensils, either alone or in any combination thereof. The present invention includes an elongate tubular member having open front and back ends; and also includes a writing tip being disposed at the front end of the elongate tubular member; and also includes a candy support assembly being removably attached to the elongate tubular member; and further includes a piece of hard candy being removably supported by the candy support assembly. None of the prior art includes the combination of the elements of the present invention.

There has thus been outlined, rather broadly, the more important features of the writing & candy utensil in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new writing & candy utensil which has many of the advantages of the writing and candy utensils mentioned heretofore and many novel features that result in a new writing & candy utensil which is not anticipated, rendered obvious, suggested, or even implied by any of the prior art writing and candy utensils, either alone or in any combination thereof.

Still another object of the present invention is to provide a new writing & candy utensil for giving a user something sweet to chew on rather than the end of the writing utensil.

Still yet another object of the present invention is to provide a new writing & candy utensil that is easy and convenient to set up and use.

Even still another object of the present invention is to provide a new writing & candy utensil that prevents the user from biting on the back ends of writing utensils and gives the user something edible and sweet to bite on while using one's writing utensil.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
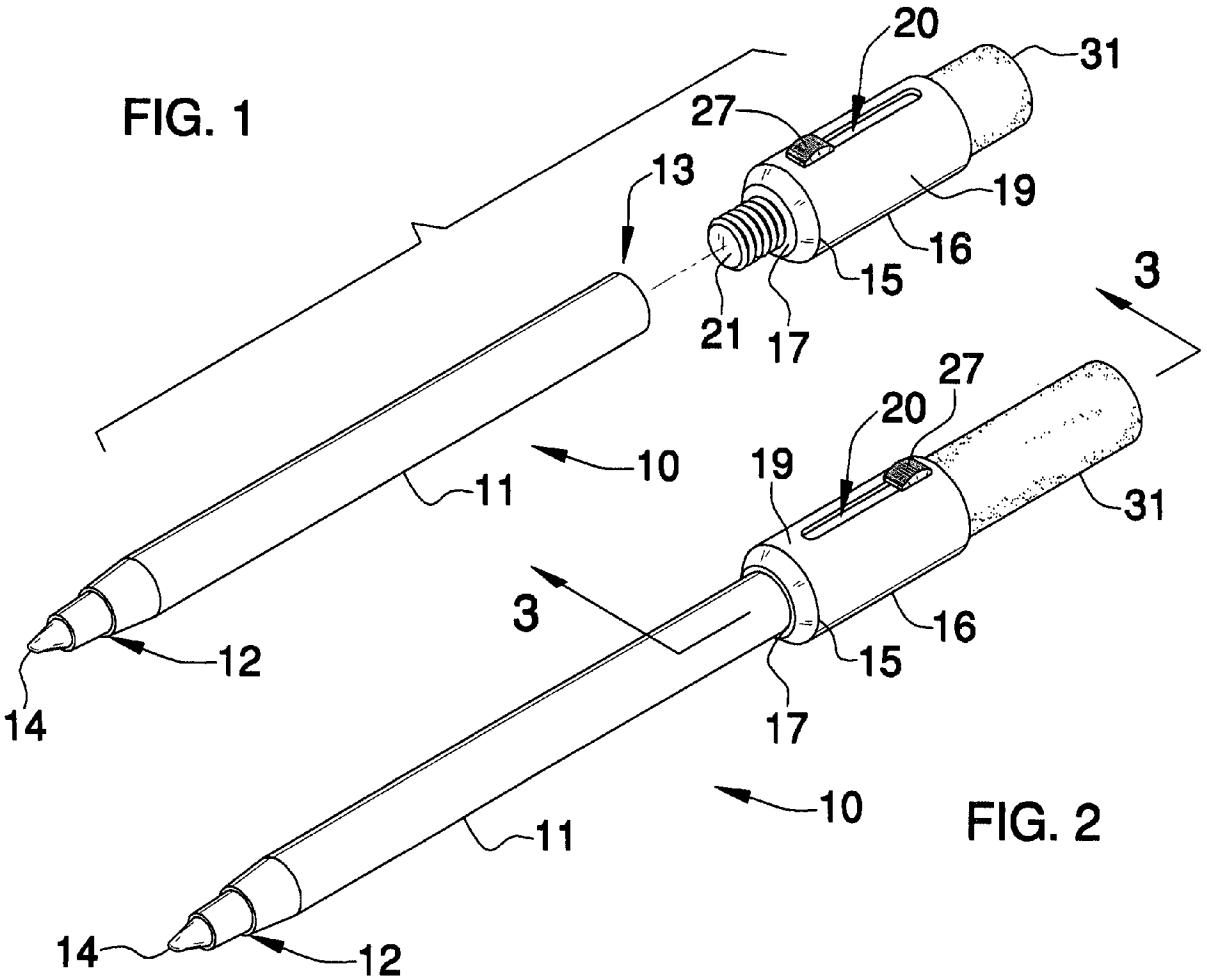
FIG. 1 is a partial exploded perspective view of a new writing & candy utensil according to the present invention.
FIG. 2 is a perspective view of the present invention.
Figure 3:
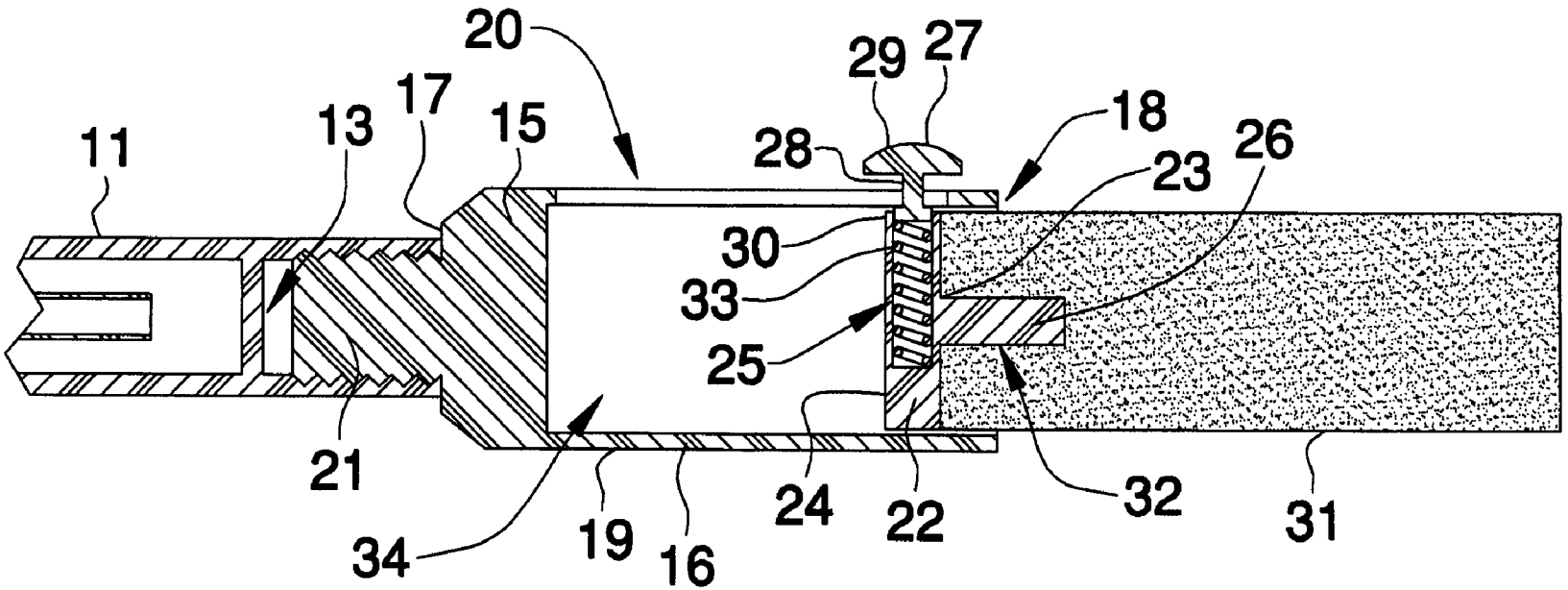
FIG. 3 is a partial cross-sectional view of the present invention.

With reference now to the drawings, and in particular to FIGS. 1 through 3 thereof, a new writing & candy utensil embodying the principles and concepts of the present invention and generally designated by the reference numeral 10 will be described.

As best illustrated in FIGS. 1 through 3, the writing & candy utensil 10 generally comprises an elongate tubular member 11 having open front and back ends 12, 13. A writing tip 14 is conventionally and securely disposed at the front end 12 of the elongate tubular member 11.

A candy support assembly is removably and conventionally attached to the elongate tubular member 11. The candy support assembly includes a candy cartridge 15 and also includes a candy dispenser 22 being movably disposed in the candy cartridge 15. The candy cartridge 15 includes a tubular portion 16 having a closed end 17 and an open end 18 and also having a bore being 34 being disposed therein and further having a longitudinal slot 20 being disposed through a side wall 19 thereof and extending from the open end 18 and terminating near the closed end 17 of the tubular portion 16; and also includes a threaded boss 21 being conventionally attached to the closed end 17 of the tubular portion 16 and extending outwardly therefrom and being threaded in the open back end 13 of the elongate tubular member 11. The candy dispenser 22 includes a candy support member 23 being movably disposed in the bore 34 of the tubular portion 16, and also includes a support release mechanism being conventionally connected to the candy support member 23 for moving and positioning the candy support member 23 in the bore 34 of the tubular portion 16. The candy support member 23 includes a support disc 24 having a radial-extending slot 25 being disposed therein through a circumferential edge thereof, and also includes a shaft member 26 being conventionally and perpendicularly-attached to the support disc 24 and extending outwardly therefrom. The support release mechanism includes a spring member 33 being disposed in the radially-extending slot 25, and also includes a release button 27 being conventionally disposed through the longitudinal slot 20 of the tubular portion 16 and being biasedly engaged to the side wall 19 of the tubular portion 16. The release button 27 includes a shaft portion 28 being disposed through the longitudinal slot 20, and also includes a head portion 29 being conventionally attached to a first end of the shaft portion 28 and being disposed outside of the tubular portion 16, and further includes a flange portion 30 being conventionally attached to a second end of the shaft portion 28 and being engageable to the side wall 19 of the tubular portion 16 in the bore 34 of the tubular portion 16.

A piece of hard candy 31 being made of conventional ingredients is removably supported by the candy support assembly. The piece of hard candy 31 has an end and also has an axial slot 32 being disposed in the piece of hard candy 31 through the end thereof with the shaft member 26 being securely engaged in the axial slot 32 of the piece of hard candy 31.

In use, the user would load and attach the piece of hard candy 31 to the shaft member 26 and would substantially retract the piece of hard candy 31 into the bore 34 of the tubular portion 16 using the release button 27. As the user consumes portions of the piece of hard candy 31, the user presses upon the release button 27 and slides the release button 27 in the longitudinal slot 20 towards the open end 18 of the tubular portion 16 to expose another portion of the piece of hard candy 31 so that the user can bite it or lick it as the user desires.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the writing & candy utensil. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A combined writing and candy utensil comprising:

an elongate tubular member having open front and back ends;

a writing tip being disposed at said front end of said elongate tubular member;

a candy support assembly being removably attached to said elongate tubular member, said candy support assembly including a candy cartridge and also including a candy dispenser being movably disposed in said candy cartridge, said candy cartridge including a tubular portion having a closed end and an open end and also having a bore being disposed therein and further having a longitudinal slot being disposed through a side wall thereof and extending from said open end and terminating near said closed end of said tubular portion; and also including a threaded boss being attached to said closed end of said tubular portion and extending outwardly therefrom and being threaded in said open back end of said elongate tubular member, said candy dispenser including a candy support member being movably disposed in said bore of said tubular portion, and also including a support release mechanism being connected to said candy support member for moving and positioning said candy support member in said bore of said tubular portion, said candy support member including a support disc having a radial-extending slot being disposed therein through a circumferential edge thereof, and also including a shaft member being perpendicularly-attached to said support disc and extending outwardly therefrom; and a piece of hard candy being removably supported by said candy support assembly.

2. A combined writing and candy utensil as described in claim 1, wherein said support release mechanism includes a spring member being disposed in said radially-extending slot, and also includes a release button being disposed through said longitudinal slot of said tubular portion and being biasedly engaged to said side wall of said tubular portion.

3. A combined writing and candy utensil as described in claim 2, wherein said release button includes a shaft portion being disposed through said longitudinal slot, and also includes a head portion being attached to a first end of said shaft portion and being disposed outside of said tubular portion, and further includes a flange portion being attached to a second end of said shaft portion and being engageable to said side wall of said tubular portion in said bore of said tubular portion.

4. A combined writing and candy utensil as described in claim 3, wherein said piece of hard candy has an end and also has an axial slot being disposed in said piece of hard candy through said end thereof, said shaft member being securely engaged in said axial slot of said piece of hard candy.

* * * * *